US005439209A

United States Patent [19]

Rünzi

[11] Patent Number: 5,439,209

[45] Date of Patent: Aug. 8, 1995

[54] PAPER STACKING APPARATUS

[76] Inventor: Kurt Rünzi, Küsnachterstrasse 59, CH-8126 Zumikon, Switzerland

[21] Appl. No.: 219,886

[22] Filed: Mar. 30, 1994

[30] Foreign Application Priority Data

Apr. 1, 1993 [DE] Germany ..... 9304964 U

[51] Int. Cl.[6] ..... B65H 9/16

[52] U.S. Cl. ..... 271/251; 271/254; 271/201; 271/207; 271/213; 271/223; 414/498; 414/529

[58] Field of Search ..... 271/184, 198, 200, 201, 271/207, 213, 214, 223, 251, 253, 254, 299, 302; 414/789.9, 791.2, 791.5, 794.5, 498, 529-536

[56] References Cited

U.S. PATENT DOCUMENTS

| | | | |
|---|---|---|---|
| 708,595 | 9/1902 | Sinnott | 271/213 |
| 815,008 | 3/1906 | Davidson | 271/302 |
| 1,141,277 | 6/1915 | Smith | 271/201 X |
| 1,305,501 | 6/1919 | Steele | 271/201 X |
| 2,642,221 | 6/1953 | Offutt et al. | 271/201 X |
| 2,660,432 | 11/1953 | Wilske et al. | 271/201 |
| 3,030,107 | 4/1962 | Stidwill | 271/201 X |
| 3,549,144 | 12/1970 | Lucas | 271/201 |
| 3,687,946 | 8/1972 | Neumann et al. | 271/201 X |
| 3,709,484 | 1/1973 | Kistner | 271/251 |

FOREIGN PATENT DOCUMENTS

| | | | |
|---|---|---|---|
| 2480720 | 10/1981 | France | 414/789.9 |
| 2520716 | 11/1975 | Germany | 414/794.5 |
| 144046 | 8/1983 | Japan | 271/213 |
| 37661 | 2/1986 | Japan | 271/207 |

*Primary Examiner*—William E. Terrell
*Assistant Examiner*—Carol L. Druzbick
*Attorney, Agent, or Firm*—Browdy and Neimark

[57] ABSTRACT

A device for arranging sheets of paper (32) in a stack (33) having a frame (2) to be mounted fixed in place, with an inlet opening (62) for introducing the sheets (32) to be stacked. The arm (4) is pivotably seated at its rear end on the frame (2) and contains a conveying member (45) driven by a motor (43) for conveying the sheets (32). A container (3) is provided for receiving the sheets (32), with a vertically displaceable carriage (12) and a drive member (15) for displacing the carriage (12). The front end of the arm (4) is pivotably connected to with the carriage (12). There is a sensor (68) at the front end of the arm (4) for detecting the upper edge of the stack (33), and a control device (67), connected with the sensor (68) and the drive member (15), for maintaining the front end of the arm (4) at the height of the stack (33) being formed. Finally, an exchangeable cassette (28) for receiving the stack (33) can be inserted into the container (3).

8 Claims, 2 Drawing Sheets

PAPER STACKING APPARATUS

BACKGROUND OF THE INVENTION

Prior Art

Stackers for forming stacks are known, for example, for use with copiers or laser printers. With such stackers intended for a great stack height, the stack is formed on a vertically displaceable table. The table is lowered into a shaft by means of a motor in such a way, that the upper edge of the stack remains at approximately the same height. If the stack is to be removed, the table is raised again.

Great stack heights result in massive structures for table guidance and a high drive output for the motor.

Object of the Invention

It is the object of the present invention to embody a device for arranging sheets of paper in a stack in such a way that its weight is small, requires little power and still can form high stacks.

An exemplary embodiment of the invention will be explained below by means of the drawings.

Figure 1:
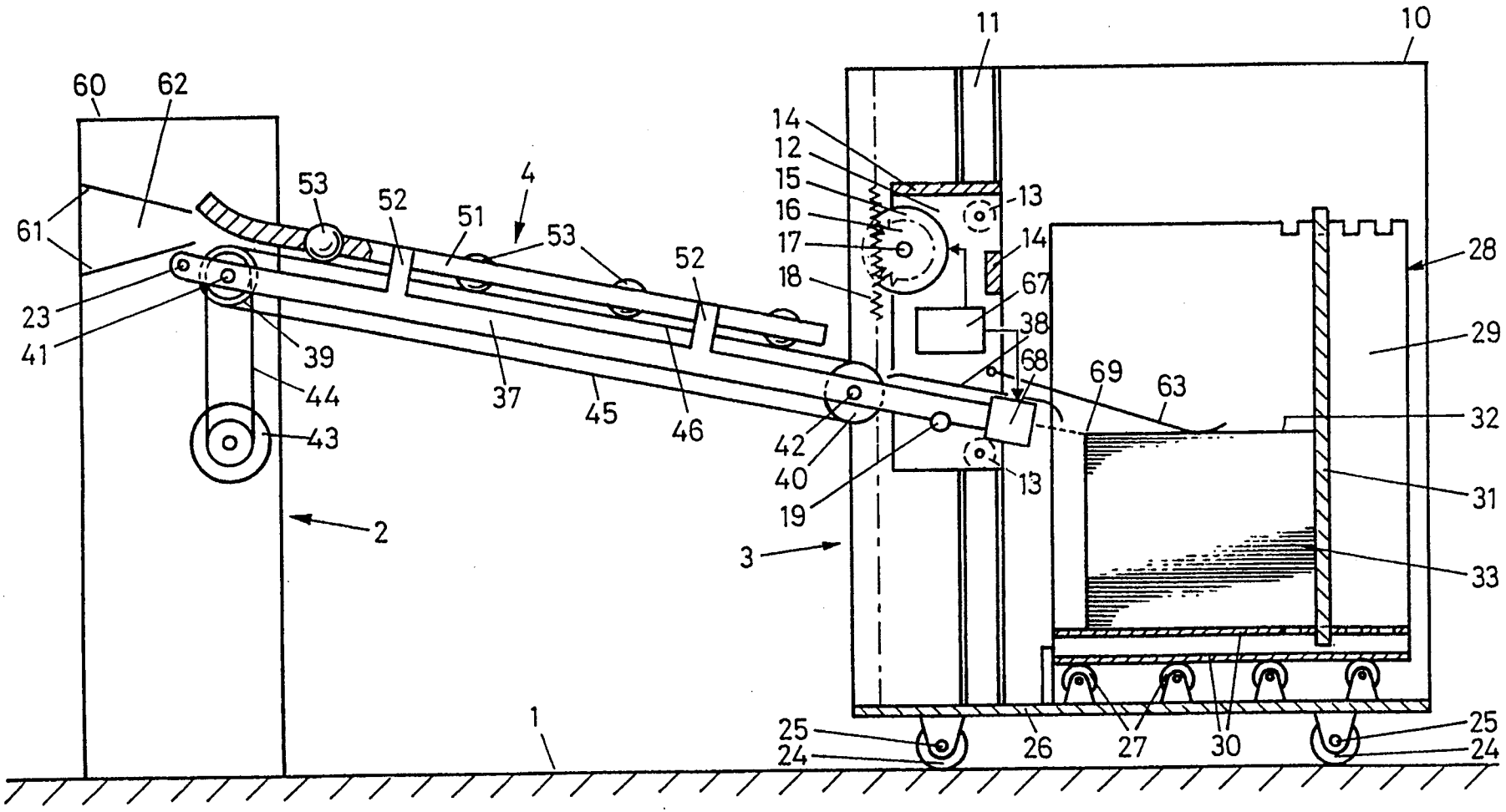
FIG. 1 shows schematic longitudinal section through a stacker.
Figure 2:
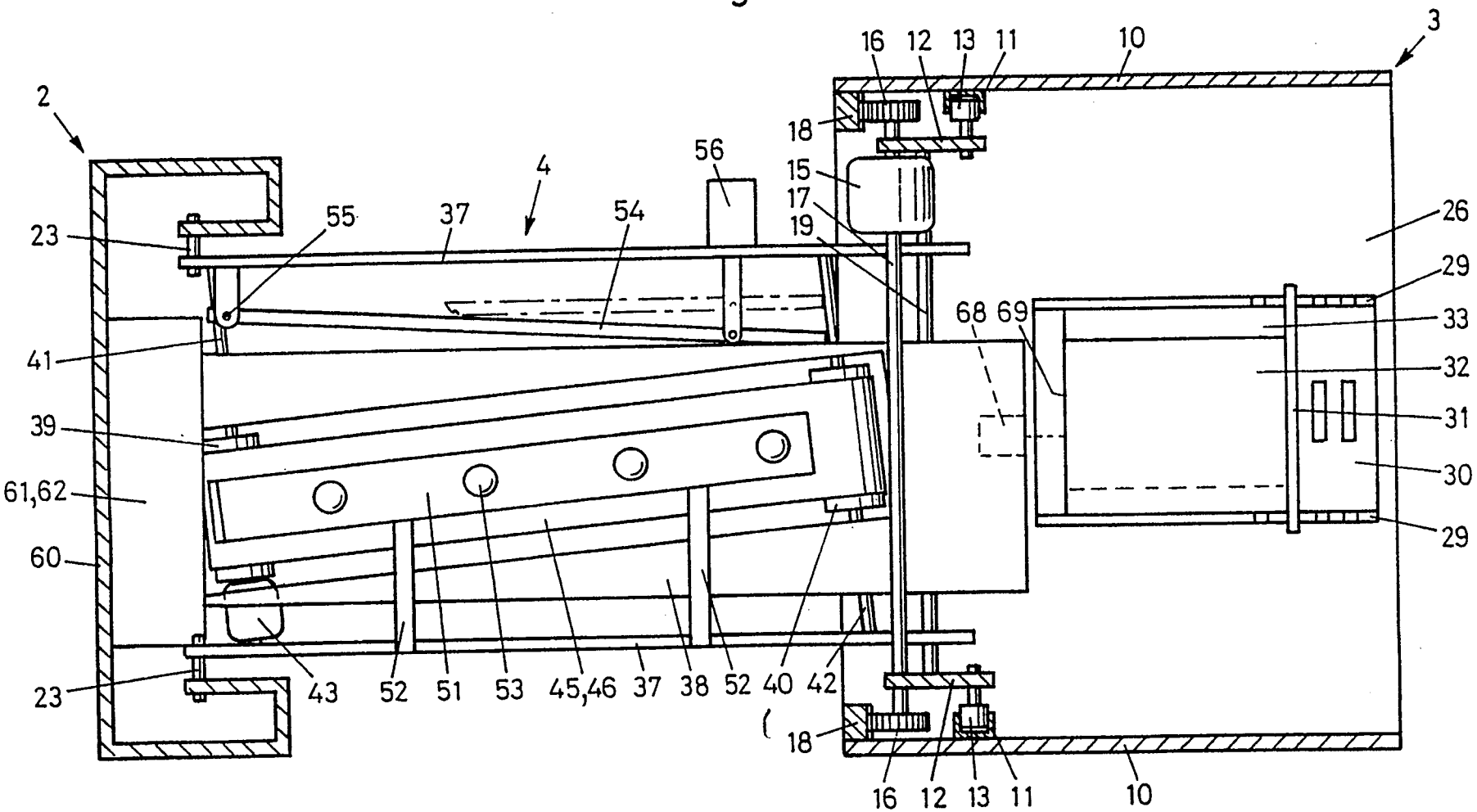
FIG. 2 shows a schematic top view of the stacker, partially in section.

The stacker of FIGS. 1 and 2 consists of a frame 2 fixedly mounted on a base 1, a container 3 and an arm 4. The container 3 has two lateral walls 10. Vertical U-shaped rails 11 are fixed on the lateral wall 10. Two carriages 12 are guided vertically movable by means of rollers 13 on each of the two carriages 12 in each of rails 11. The two carriages 12 can be connected with each other by connecting braces 14. The carriages 12 can be vertically displaced along the rail 11 by means of a gear motor 15. For this purpose, each of two pinions 16 on the ends of power-take-off shaft 17 of the motor 15 engage respectively one of two toothed racks 18 fastened on the lateral walls 10. By means of this, parallel guidance of the two carriages 12 is simultaneously provided. The two carriages 12 are also connected with each other by means of a round rod 19.

The arm 4 is seated in the rear end of the frame 2, pivotable around a horizontal pivot shaft 23 extending crosswise to its long direction, and its front end is pivotably snapped onto the round rod 19. The rod 19 extends parallel to the shaft 23. The container 3 is seated on rollers 24, which are rotatably seated on shafts 25 parallel to the shaft 23, to make possible the pivot movement of the arm 4. A plurality of rollers 27 are rotatably seated on the base 26 of the container 3. A cassette 28 is supported on rollers 27. The cassette 28 consists of two lateral walls 29, a double bottom 30 and an adjustable, plugged-in stop plate 31. The paper sheets 32 supplied via the arm 4 come to rest against this plate 31, so that the stack 33 is formed in the cassette 28.

The arm 4 has two carriers 37 which have in the rear two axle stubs which form the pivot shaft 23 and support a sliding plate 38. At the front these carriers 37 are seated with a semicircular recess on the rod 19. Two reversing cylinders 39, 40 are seated on the carriers 37 and are rotatable around shafts 41, 42. The cylinder 39 is driven by a motor 43 either directly (FIG. 2) or via a belt 44 (FIG. 1). A conveyor belt 45 is guided around the cylinders 39, 40. The upper surface of its top side 46 lies in the same plane as the surface of the sliding plate 38.

A rail 51 is disposed above the top side 46. The rail 51 is connected with the one carrier 37 via struts 52. A plurality of spheres 53 have been loosely inserted into it, rest on the conveyor belt 45 and by their own weight press a conveyed sheet 32 form stack 33 against the belt 45. In the vicinity of the rear end of the other carrier 37 a guide rail 54 is seated so it is pivotable around a vertical shaft 55. By means of a lift magnet 56 or the motor, the rail 54 can be pivoted out of its base position, shown by a solid line in FIG. 2, into a pivot position indicated by dash-dotted lines. The conveyor belt 45 extends slightly tilted in respect to the longitudinal axis of the arm 4 in such a way that in both pivot positions of the rail 54 it slightly converges toward it in the direction of feed. By means of this the long edge of the conveyed sheet 32 strikes against the rail 54. The two pivot positions of the rail 54 are used to separate orders. If a bundle of sheets 32 which belong together has been placed on the stack 33, the rail 54 is pivoted into the other pivot position, so that the next bundle which belongs together is placed down slightly offset to the side. In this way it is possible later to easily separate the individual orders from each other.

An inlet cone 62 is formed in the housing 60 of the frame 2 by means of two sheet metal plates 61, which guides the supplied sheet 32 between the rail 51 and the conveyor belt 45. In a useful manner a light hold-down device 63 is pivotably seated on the carriage 12, which prevents the rebound of the sheets.

A control device 67 is used to control the vertical position of the carriage 12 and is connected with a reflected light barrier 68 at the front end of the arm 4. The reflected light barrier 68 detects the upper rear edge 69 of the stack 33. The control device 67 controls the motor 15 in such a way that the optical axis of the light barrier 68 is always directed on this edge 69.

The described device can be made to be very light, since the carriage 12 and the motor 15 only have to displace the small weight of the arm 4. In addition, this arm 4 can be balanced, for example by means of a cable pull with a counterweight, or by means of a spring, for example a telescoping spring. The completed stack can be taken out very quickly and easily. Because of the displaceable container 3, the arm 4 does not need to telescope. For these reasons the device can be produced cost-effectively and is easy to transport and assemble.

In a variant of the embodiment shown, the cassette 28 can also be embodied as a carriage which is directly supported on the base 1 by means of rollers and is connected with the container 3. In this case the filled cassette can be moved away particularly easily.

In a variant of the embodiment shown, the container 3 can also be fixedly mounted on the base 1 and the arm 4 can be telescoping instead.

The described device for separating orders and consisting of the pivotable striker plate 54, the conveyor belt 45 converging toward this rail 54 in the feed direction, and the freely rotatable roller elements (spheres), can also be usefully employed in other than the described stacking device.

I claim:

1. A device for arranging sheets of paper (32) in a stack (33), comprising:

a frame (2) to be mounted fixed in place, with an inlet opening (62) for introducing the sheets (32) to be stacked, an arm (4) pivotably seated at its rear end on the frame (2) and containing a conveying member (45) driven by a motor (43) for conveying the sheets (32), a container (3) for receiving the sheets (32), with a vertically displaceable carriage (12) and a drive member (15) for displacing the carriage (12), wherein the front end of the arm (4) is pivotably connected with the carriage (12), a sensor (68) at the front end of the arm (4) for detecting the upper edge of the stack (33), and a control device (67), connected with the sensor (68) and the drive member (15), for maintaining the front end of the arm (4) at the height of the stack (33) being formed, wherein an exchangeable cassette (28) for receiving the stack (33) is inserted into the container (3).

2. A device in accordance with claim 1, wherein a stop (31), against which the paper sheets come to rest, is adjustably inserted into the cassette (28).

3. A device in accordance with claim 1, further comprising rollers (27) between the cassette (28) and the container (3), wherein the cassette (28) can be inserted into the container (3) on the rollers (27).

4. A device in accordance with claim 1, wherein the container (3) is seated on rollers (24), the shafts (25) of said rollers extending parallel to two pivot shafts (23, 19) of the am (4).

5. A device in accordance with claim 1, wherein the sensor (68) is a light barrier.

6. A device in accordance with claim 1, wherein the conveying member is a conveyor belt (45) and the arm (4) has a rail (51) above the conveyor belt (45), in which a plurality of spheres (53) are maintained freely rotatable, which rest on the conveyor belt (45).

7. A device for arranging sheets of paper (32) in a stack (33), comprising:

a frame (2) to be mounted fixed in place, with an inlet opening (62) for introducing the sheets (32) to be stacked, an arm (4) pivotably seated at its rear end on the frame (2) and containing a conveyor belt (45) driven by a motor (43) for conveying the sheets (32), the arm (4) having a rail (51) above the conveyor belt (45), in which a plurality of spheres (53) are maintained freely rotatable, which rest on the conveyor belt (45), a container (3) for receiving the sheets (32), with a vertically displaceable carriage (12) and a drive member (15) for displacing the carriage (12), wherein the front end of the arm (4) is pivotably connected with the carriage (12), a sensor (68) at the front end of the arm (4) for detecting the upper edge of the stack (33), and a control device (67), connected with the sensor (68) and the drive member (15), for maintaining the front end of the arm (4) at the height of the stack (33) being formed, wherein a guide rail (54), which is pivotably seated on a vertical shaft (55) in the vicinity of a rear end of the arm (4) and which can be displaced by means of a lifting member (56) into two pivot positions, is disposed on one side of the conveyor belt (45), and wherein the conveyor belt (45) extends inclined in a direction of the guide rail (54) in such a way, that in the two pivot positions of the guide rail (54) the rail and the conveyor belt (45) converge in a direction of travel of the belt.

8. A device for arranging sheets of paper (32) in a stack (33), comprising:

an arm (4) containing a conveyor belt (45) driven by a motor (43), said arm conveying sheets (32), the arm (4) having a rail (51) above the conveyor belt (45), in which a plurality of rolling elements (53) are maintained freely rotatable, the rolling elements resting on the conveyor belt (45), a container (3) for receiving the sheets (32), and a guide rail (54), which is pivotably seated on a vertical shaft (55) in the vicinity of a rear end of said guide rail and which can be displaced by means of a lifting member (56) into two pivot positions, the guide rail being disposed on one side of the conveyor belt (45), the conveyor belt (45) extending inclined in a direction of the guide rail (54) in such a way, that in the two pivot positions of the guide rail (54), the rail and the conveyor belt (45) converge in a direction of travel of the belt.

* * * * *